United States Patent [19]

Eschenbach

[11] Patent Number: 4,467,594

[45] Date of Patent: Aug. 28, 1984

[54] SPUN-LIKE TEXTURED YARN

[75] Inventor: Paul W. Eschenbach, Moore, S.C.

[73] Assignee: Milliken Research Corporation, Spartanburg, S.C.

[21] Appl. No.: 455,074

[22] Filed: Jan. 3, 1983

Related U.S. Application Data

[63] Continuation of Ser. No. 240,732, Mar. 5, 1981, abandoned.

[51] Int. Cl.[3] ..... D02G 1/16; D02G 3/34

[52] U.S. Cl. ..... 57/207; 57/208; 57/6; 57/351; 57/908; 28/271

[58] Field of Search ..... 57/6, 207–209, 57/243, 248, 288–290, 295, 328, 350, 351, 908; 28/271, 281

[56] References Cited

U.S. PATENT DOCUMENTS

| | | | |
|---|---|---|---|
| 2,997,838 | 8/1961 | Sinski | 57/157 |
| 3,083,522 | 4/1963 | Rakowski et al. | 57/34 |
| 3,199,281 | 8/1965 | Maerov et al. | 57/908 X |
| 3,433,008 | 3/1969 | Gage | 57/246 |
| 3,438,194 | 4/1969 | Cerutti et al. | 57/157 |
| 3,457,715 | 7/1969 | Eldridge et al. | 57/6 |
| 3,474,613 | 10/1969 | Joarder et al. | 57/34 |
| 3,517,498 | 6/1970 | Burellier et al. | 57/91 |
| 3,609,835 | 10/1971 | Boon | 28/1.4 |
| 3,640,064 | 2/1972 | Palm et al. | 57/144 |
| 3,685,268 | 8/1972 | Sequin | 57/34 |
| 3,749,055 | 7/1973 | Benson | 118/234 |
| 3,812,665 | 5/1974 | Holland | 57/34 |
| 3,945,189 | 3/1976 | Allen | 57/160 |
| 3,955,952 | 5/1976 | Drummond | 65/3 |
| 4,000,551 | 1/1977 | Holden | 28/72.12 |
| 4,010,601 | 3/1977 | Anahara et al. | 57/160 |
| 4,058,968 | 11/1977 | Benson | 57/140 |
| 4,080,777 | 3/1978 | Griset, Jr. | 57/140 |
| 4,081,887 | 4/1978 | Holden | 28/271 |
| 4,145,869 | 3/1979 | Duncan et al. | 57/207 |
| 4,159,619 | 7/1979 | Griset, Jr. | 57/295 |
| 4,170,865 | 10/1979 | Pike | 57/6 |
| 4,218,869 | 9/1980 | Newton | 57/908 X |
| 4,219,997 | 9/1980 | Hatcher | 57/908 X |
| 4,222,223 | 9/1980 | Nelson | 57/908 X |
| 4,248,036 | 2/1981 | Barron | 57/908 X |

*Primary Examiner*—Donald Watkins

*Attorney, Agent, or Firm*—Earle R. Marden; H. William Petry

[57] ABSTRACT

Method to produce spun-like yarn and product produced thereby by combining a core yarn and an effect yarn in an air jet. The removal speed of the combined yarn from the air jet is intermediate of the speeds of the draw rolls to produce a composite yarn having crunodal loops in one of the combined yarns.

3 Claims, 2 Drawing Figures

SPUN-LIKE TEXTURED YARN

This is a continuation of application Ser. No. 240,732, filed Mar. 5, 1981, now abandoned.

This invention relates generally to yarn produced by combining two false twisted yarns in an air jet to supply a continuous, multi-filament textured, spun-like yarn.

It is therefore an object of the invention to provide a method to produce a novel, multi-filament yarn.

Figure 1:
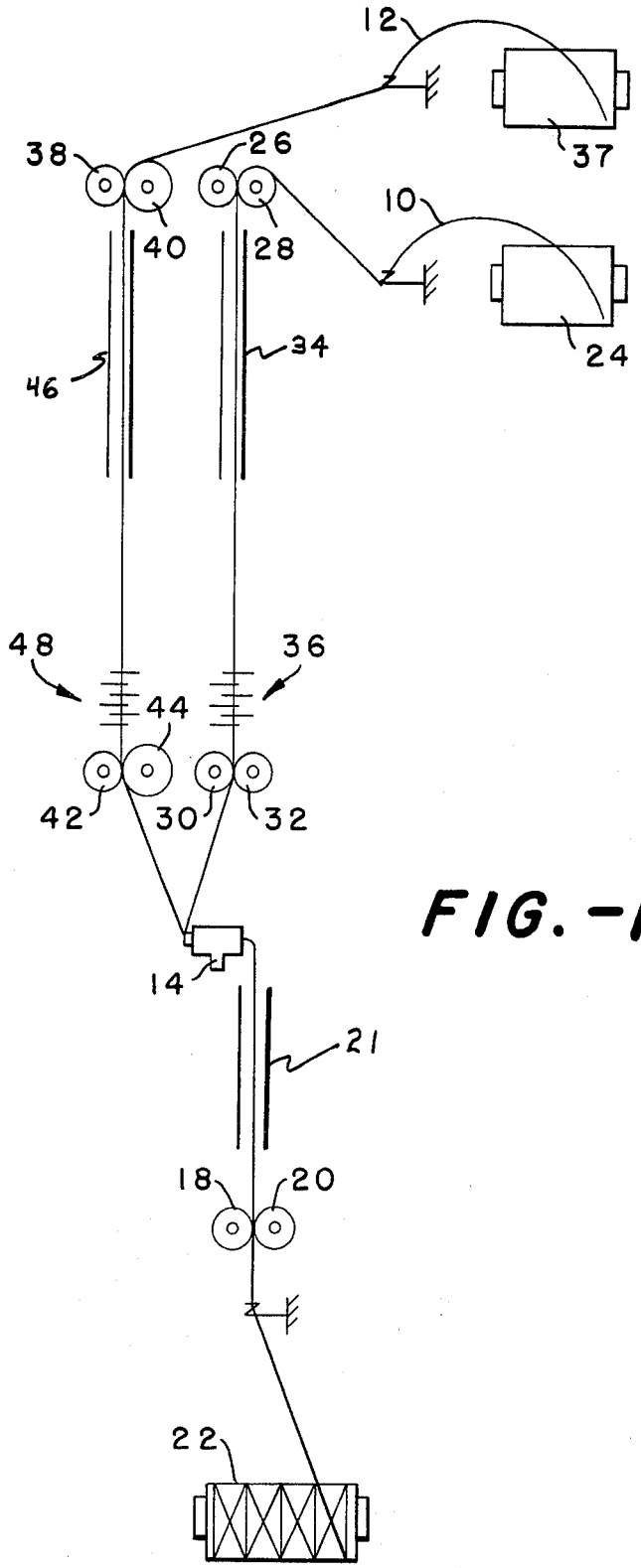
Figure 2:
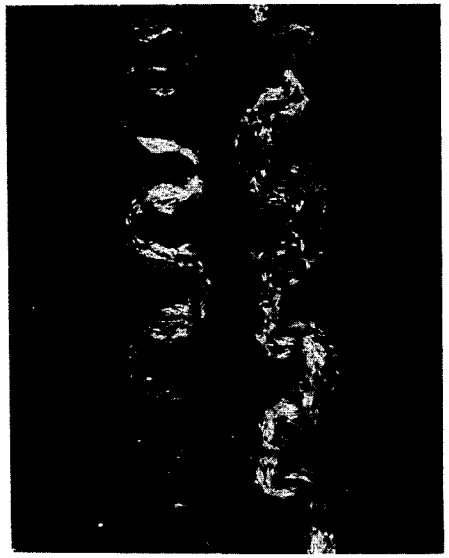

Other objects and advantages of the invention will become readily apparent as the specification proceeds to describe the invention with reference to the accompanying drawing, in which:

FIG. 1 is a schematic representation of the apparatus and method to produce the novel yarn, and FIG. 2 is an enlarged photographic representation of the yarn produced.

Looking now to the drawings, there is shown one embodiment of an apparatus for producing the novel yarn composed of a core yarn and an effect yarn. In the preferred form of the invention, both the core yarn 10 and the effect yarn 12 are continuous, multi-filament, partially oriented synthetic yarns.

The core and effect yarns 10 and 12 are combined in the air jet 14 to produce the textured yarn 16 which is delivered by the take-up nip rolls 18 and 20 through the secondary heater 21 to the take-up roll 22. The core yarn 10 is delivered from the package 24 to the false twist zone by the first delivery rolls 26 and 28. The second delivery rolls 30 and 32 draw the core yarn 10 as it passes through the primary heater 34 and the false twist device 36, illustrated as friction discs, and supplies it to the air jet 14.

The effect yarn 12 is delivered from the package 37 to the false twist zone by the first delivery rolls 38 and 40 and is drawn by the second delivery rolls 42 and 44 as it passes through the primary heater 46 and false twist device 48, illustrated as friction discs. From the delivery rolls 42 and 44, the effect yarn 12 is delivered to the air jet 14.

The speeds of the delivery rolls are pre-selected to provide a desired result in the yarn produced. In the preferred form of the invention, the speed of the rolls 26, 28, 38 and 40 is so selected that the speed of the effect yarn 12 being delivered thereby is greater than the speed of the core yarn 10. The speeds of the delivery rolls 30, 32, 42 and 44 are so selected that the delivery speed of the effect yarn 12 is greater than the speed of the core yarn 10. In the preferred form of the invention, since partially oriented yarn is being run, the speeds of rolls 30, 32, 42 and 44 are so selected to draw the effect and core yarns. The speed of the delivery rolls 18 and 20 is so selected that the yarn 16 delivered therefrom is at a speed lower than the speed of either the core yarn 10 or the effect yarn 12, respectively, from the rolls 30 and 32 or 42 and 44, but greater than the speed of the yarn delivered by the rolls 38 and 40 or 26 and 28.

Looking now to FIG. 2, it can be seen that the higher speed, overfed effect yarn 12 forms crunodal loops in the air jet 14 which project through and intermingle with the core yarn 10 and are twisted to hold the filaments of the composite yarn together to provide a spun-like yarn. It has been found that the best effort is achieved when the air pressure supplied to the jet is 100 psig or greater. As a practical matter, the air pressure "P" should be equal to or greater than 100 psig when the yarn denier is 300 or less. The desired air pressure is computed as follows:

$$P(\text{psig}) = -0.001875x^2 + 0.95x + 23.75$$

x = total yarn denier into the jet

The air jet 14 is a commercially available type and does not per se form a part of the invention other than that it accomplishes the desired result of combining and texturing the yarn.

The following is an example of the production of a yarn in the manner herinbefore described.

EXAMPLE

The effect yarn is 150 denier, 68 filament, partially oriented polyester disperse dyeable yarn. The core yarn is 154 denier, 34 filament, cationic dyeable, partially oriented polyester yarn. The resultant combined yarn is 323 denier polyester yarn.

The combined yarn is formed under the following parameters:

Effect yarn velocity from first delivery rolls—204 meters/minute

Core yarn velocity from first delivery rolls—187 meters/minute

Primary heater 34 temperature—200° C.

Effect yarn velocity from second delivery rolls—342 meters/minute

Core yarn velocity from second delivery rolls—313 meters/minute

Draw ratio effect yarn—1.674

Draw ratio core yarn—1.674

Jet air pressure—140 psig

Heater 46—temperature 200° C.

Combined yarn velocity to take-up rolls—281 meters/-minute

Secondary heater 21—off

Combined yarn take-up velocity—297 meters/minute

It is obvious that an air textured spun-like yarn has been provided by efficiently combining a false twisted, drawn core yarn and a false twisted, drawn effect yarn in an apparatus which employs air under pressure to commingle and texture the filaments of the core and effect yarns.

Although the preferred embodiment of the invention has been described specifically, it is contemplated that many changes may be made without departing from the scope or spirit of the invention, and I desire to be limited only by the claims.

I claim:

1. A process of making an air textured yarn having a core yarn and effect yarn comprising the steps of: supplying a first partially oriented yarn at a first feed rate, supplying a second partially oriented yarn at a second feed rate, heating the first and second yarns after supplying at their respective first and second feed rates, drawing the first yarn at a third feed rate after heating, drawing the second yarn at a fourth feed rate after heating, supplying the drawn first and second yarns into an air jet, means supplying gaseous fluid at a pressure equal to or greater than 100 p.s.i.g. into the air jet to commingle and texture the first and second yarns by causing the second yarn to form crunodal loops which project through the filaments of the first yarn and are twisted at the base thereof to hold the first and second yarns together and withdrawing the commingled spun-like yarn from the air jet at a third rate which is greater than the first and second feeds but less than the third and fourth feed rates.

2. The process of claim 1 wherein the gaseous fluid pressure is equal to $-0.001875$ x (yarn denier into the jet)$^2+0.95$ x (yarn denier into the jet)$+23.75$.

3. A commingled, textured yarn comprising a multi-filament, synthetic continuous filament core yarn commingled by air jet with a multi-filament, synthetic continuous filament effect yarn which has crunodal loops therein which project between filaments of the core yarn and twisted at the base thereof to hold the core and effect yarns together.

* * * * *